US011737549B2

(12) United States Patent
Cruickshank

(10) Patent No.: US 11,737,549 B2
(45) Date of Patent: Aug. 29, 2023

(54) PORTABLE STAKED ACCESSORY HOLDER

(71) Applicant: Halsey Cruickshank, Brooklyn, NY (US)

(72) Inventor: Halsey Cruickshank, Brooklyn, NY (US)

( * ) Notice: Subject to any disclaimer, the term of this patent is extended or adjusted under 35 U.S.C. 154(b) by 0 days.

(21) Appl. No.: 17/132,523

(22) Filed: Dec. 23, 2020

(65) Prior Publication Data

US 2021/0106129 A1 Apr. 15, 2021

Related U.S. Application Data

(63) Continuation-in-part of application No. 16/013,471, filed on Jun. 20, 2018, now abandoned.

(51) Int. Cl.

| | |
|---|---|
| ***A47G 25/12*** | (2006.01) |
| ***A45F 3/44*** | (2006.01) |
| ***A47G 19/22*** | (2006.01) |
| ***A47G 23/02*** | (2006.01) |

(52) U.S. Cl.

CPC ..... *A45F 3/44* (2013.01); *A47G 19/2255* (2013.01); *A47G 23/0225* (2013.01); *A45F 2200/0583* (2013.01); *A47G 2019/2277* (2013.01)

(58) Field of Classification Search

CPC ..... A47F 3/44; A47F 2200/0583; A47F 2003/205; A47G 19/2252; A47G 19/2205; A47G 23/0225; A47G 2019/2277; B65D 21/086; A45F 3/44; A45F 2200/0583; A45F 2003/205

USPC ..... 211/195; 248/156, 121, 530, 188.5; 220/8, 737, 495.03, 666, 592.17

See application file for complete search history.

(56) References Cited

U.S. PATENT DOCUMENTS

| | | | | |
|---|---|---|---|---|
| 577,764 | A * | 2/1897 | Lines | B65D 21/086 220/8 |
| 3,216,166 | A * | 11/1965 | Brown | F16B 5/0642 52/483.1 |
| 4,334,661 | A | 6/1982 | Pitt | |
| 5,819,720 | A * | 10/1998 | Schubert | A47J 37/0763 126/41 R |
| 6,575,417 | B1 * | 6/2003 | Krommenakker | A47G 23/0225 248/156 |
| 11,377,866 | B1 | 7/2022 | Conlon | |

(Continued)

FOREIGN PATENT DOCUMENTS

| | | | | |
|---|---|---|---|---|
| GB | 367925 | * | 8/1931 | A47G 23/02 |

*Primary Examiner* — John K Fristoe, Jr.
*Assistant Examiner* — Elizabeth J Volz

(57) ABSTRACT

A portable staked accessory holder is an apparatus that mounted into the ground to uphold various small items. The apparatus includes a tray, a telescopic post assembly, and a stake. The tray upholds small items such as a beverage cup or a small plate. The telescopic post assembly offsets the tray from the ground and is height adjustable. The stake drives into and mounts into the ground. The apparatus further includes a beverage holder, an electronic device holder, and a spring clamp. The beverage holder attaches a beverage with the telescopic post assembly so that the tray remains uninhibited and the space of the tray is maximized. The electronic device holder upholds an electronic device such as a smart phone with the beverage holder for easy access. The spring clamp allows the beverage holder, and consequently the electronic device holder to be attached and removed with the telescopic post assembly.

7 Claims, 6 Drawing Sheets

(56) References Cited

U.S. PATENT DOCUMENTS

| | | | | |
|---|---|---|---|---|
| 2004/0129184 | A1 | 7/2004 | Kraker | |
| 2007/0017108 | A1* | 1/2007 | Hanson | E04F 21/00 33/479 |
| 2009/0294622 | A1 | 12/2009 | Medders et al. | |
| 2014/0326283 | A1* | 11/2014 | Silberman | A45B 25/22 135/15.1 |

* cited by examiner

PORTABLE STAKED ACCESSORY HOLDER

The current application is a continuation-in-part (CIP) application of a U.S. non-provisional application Ser. No. 16/013,471 filed on Jun. 20, 2018. The U.S. non-provisional application Ser. No. 16/013,471 claims a priority to a U.S. provisional application Ser. No. 62/440,090 filed on Dec. 29, 2016.

FIELD OF THE INVENTION

The present invention generally relates to stakes. More specifically, the present invention is a portable staked accessory holder.

BACKGROUND OF THE INVENTION

Drinking cups and small plates are a staple at any social event. However, it is difficult to maneuver throughout a social event while holding both food and beverage and maintaining conversation or participating in activities. The best solution to this problem is to rest the drinking cup on a table or flat surface. This, however, allows an individual to easily forget about his or her beverage and does not protect the drinking cup from being toppled.

The present invention allows a user to safely mount and easily retrieve his or her beverage, plate, and a variety of other handheld items. The present invention is a portable staked accessory holder that is easy to wash and store. The present invention requires the least amount of space as the tray may be fully retracted.

DETAIL DESCRIPTIONS OF THE INVENTION

Figure 1:
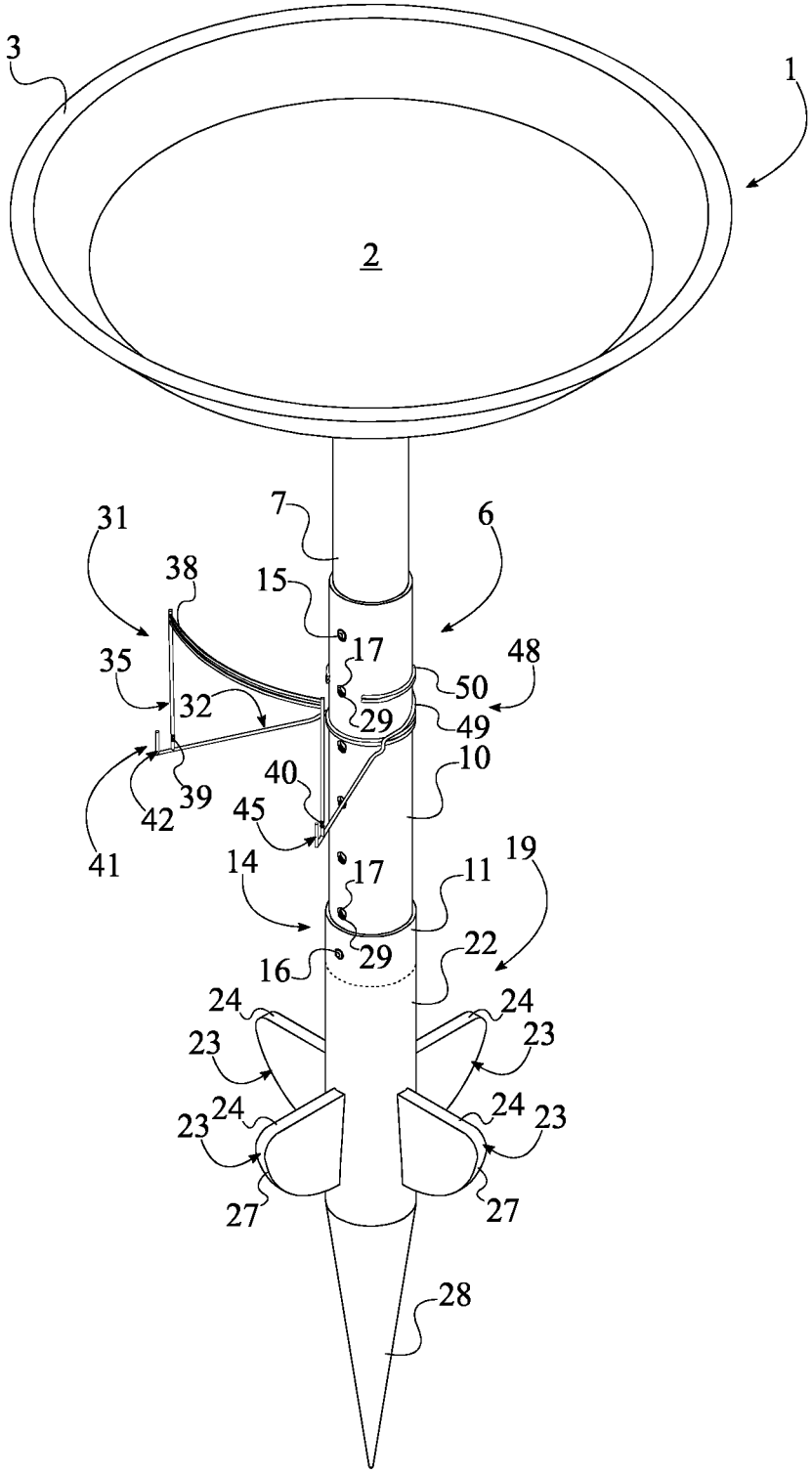
FIG. 1 is a top perspective view of the present invention.

All illustrations of the drawings are for the purpose of describing selected versions of the present invention and are not intended to limit the scope of the present invention.

The present invention is a portable staked accessory holder. The portable staked accessory holder serves as a universal mount for a variety of small items. The present invention more specifically upholds a variety of items above the ground. The present invention may be utilized during outdoor gatherings or outdoor activities. The present invention is also compact and modular, easily stored with minimal space required. In order to securely uphold small items at any desired position across the ground, the present invention comprises a tray 1, a telescopic post assembly 6, and a stake 19, seen in FIG. 1, FIG. 2, FIG. 3, FIG. 4, FIG. 5, and FIG. 6. The tray 1 upholds small items such as a small plate of food. The tray 1 comprises a base plate 2, a lateral wall 3, and a flange 4. The stake 19 comprises a proximal end 20 and a distal end 21. The base plate 2 supports the variety of small items, and the lateral wall 3 contains the variety of small items. The flange 4 allows the tray 1 to be mounted onto the telescopic post assembly 6. The telescopic post assembly 6 allows the tray 1 to be offset from the ground at various heights. The stake 19 mounts the telescopic post assembly 6, and consequently, the tray 1, securely into the ground. Furthermore, the stake 19 comprises a proximal end 20 and a distal end 21. The proximal end 20 mounts the telescopic post assembly 6, and the distal end 21 engages with the ground.

The overall configuration of the aforementioned components allows the present invention to securely uphold small items at varying heights. In order to support small items, the lateral wall 3 is positioned adjacent with the base plate 2 and is perimetrically fixed around the base plate 2, seen in FIG. 1, FIG. 2, and FIG. 3. The space of the base plate 2 is maximized while connecting with the telescopic post assembly 6 as the flange 4 is positioned adjacent with the base plate 2, opposite the lateral wall 3 and is concentrically fixed with the base plate 2. The telescopic post assembly 6 is positioned adjacent with the base plate 2 and is frictionally engaged into the flange 4, thereby securely mounting the tray 1 onto the telescopic post assembly 6. In order to dismantle the present invention, the tray 1 is removed from the telescopic post assembly 6 by pulling off the tray 1 until the telescopic post assembly 6 is past the grip of the flange 4. The stake 19 is positioned adjacent with the telescopic post assembly 6, opposite the tray 1. This arrangement maintains an upright configuration of the present invention while allowing the present invention to be mounted into the ground. The distal end 21 is positioned opposite the proximal end 20 about the stake 19. The proximal end 20 is fixed with the telescopic post assembly 6.

Figure 2:
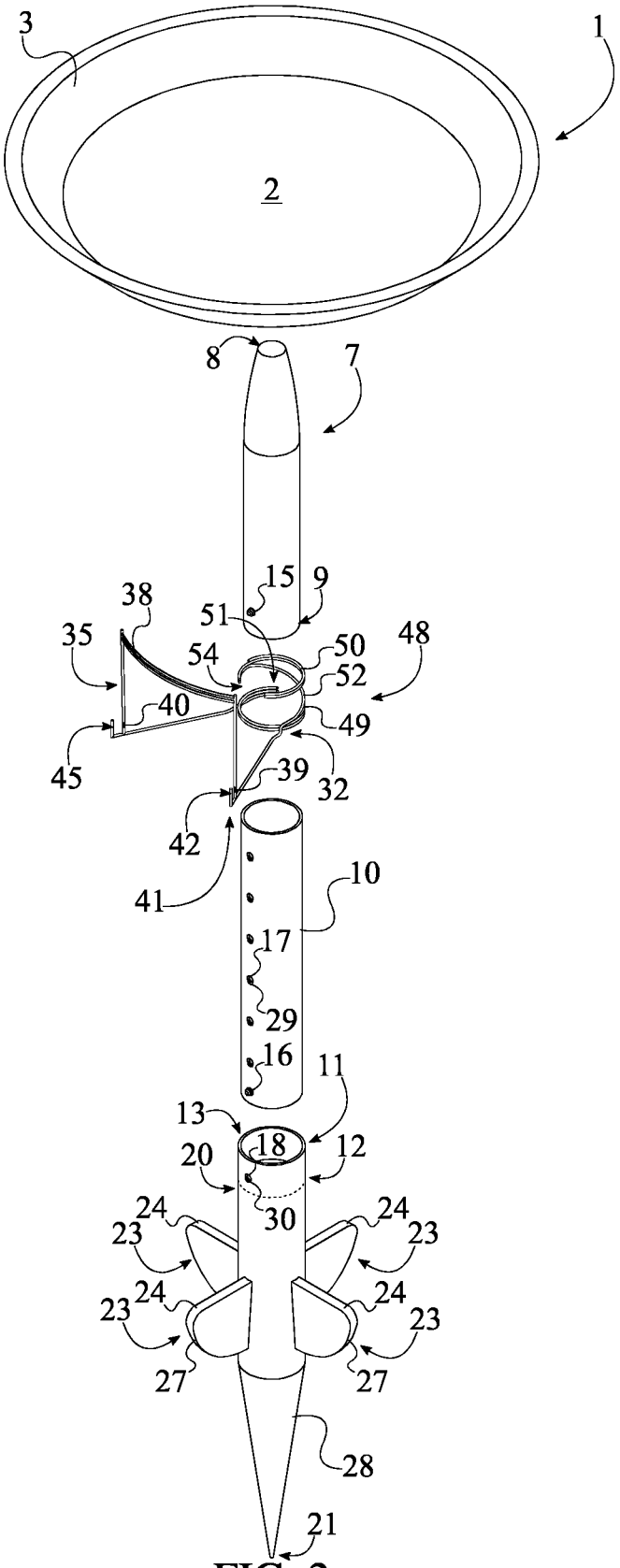
FIG. 2 is a top exploded view of the present invention.
Figure 3:
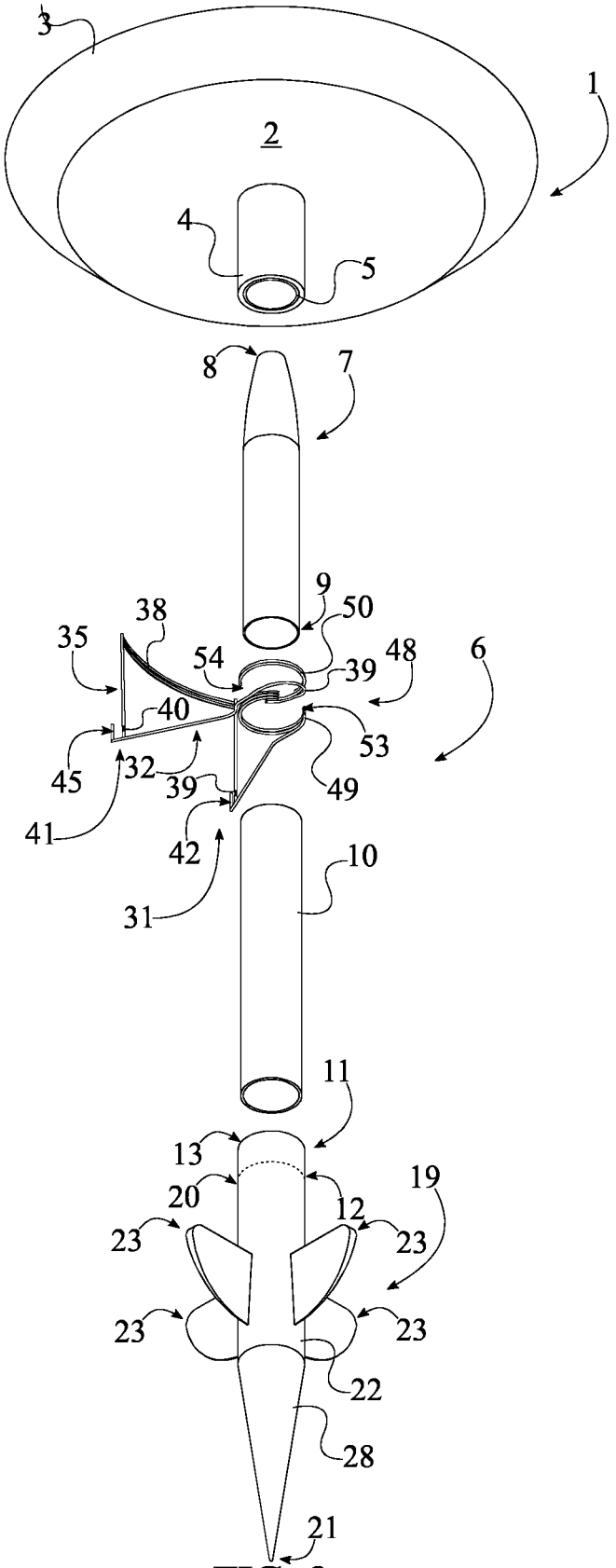
FIG. 3 is a bottom exploded view of the present invention.

In order for the height of the present to be easily and safely adjusted, the telescopic post assembly 6 comprises a connecting post 7, a first tube 10, a second tube 11, and a locking mechanism 14, seen in FIG. 2 and FIG. 3. The connecting post 7 attaches the tray 1 onto the telescopic post assembly 6. Moreover, the connecting post 7 adjusts the height of the present invention with the first tube 10. The connecting post 7 comprises a first end 8 and a second end 9. The first end 8 is positioned opposite the second end 9 about the connecting post 7. The second tube 11 connects the telescopic post assembly 6 with the stake 19 and allows the telescopic post to be easily dissembled. The locking mechanism 14 secure the connecting post 7 with the first tube 10 and the first tube 10 with the second tube 11. The tray 1 is offset from the ground as the first tube 10 is positioned in between the connecting post 7 and the second tube 11. In order for height of the present invention to remain adjustable while mounted into the ground, the stake 19 is positioned adjacent with a closed end 12 of the second tube 11, and an open end 13 of the second tube 11 is positioned opposite the closed end 12. The first end 8 securely connects the tray 1 with the telescopic post assembly 6 as the first end 8 is frictionally engaged into the flange 4. The height of the present invention is adjustable as the second end 9 is slidably engaged into the first tube 10. The telescopic post assembly 6 is upheld by the stake 19 as the stake 19 is mounted onto the closed end 12 of the second tube 11. The first tube 10 is slidably engaged into the open end 13 of the second tube 11, thereby securing the telescopic post assembly 6 into the stake 19. The connection between the flange 4 with the connecting post 7, the position of the connecting post 7 along the first tube 10, and the connection between the first tube 10 with the second tube 11 is defined as the locking mechanism 14 is operatively integrated into the connecting post 7, the first tube 10, and the second tube 11, wherein the locking mechanism 14 is used to adjust and fix a total height for the telescopic post assembly 6. The total height of the telescopic post assembly 6 is the distance between the flange 4 and the stake 19.

In the preferred embodiment of the present invention, the locking mechanism 14 comprises a first spring-loaded button 15, a second spring-loaded button 16, at least one height-adjustable hole 17, and an anchoring hole 18, also seen in FIG. 2 and FIG. 3. The first spring-loaded button 15 secures the connecting post 7 into the first tube 10 through the at least one adjustable hole. The second spring-loaded button 16 secures the first tube 10 into the second tube 11 through the anchoring hole 18. The first spring-loaded button 15 is laterally mounted into the connecting post 7 and is positioned adjacent with the second end 9, maximizing the height of the connecting post 7, the first tube 10, and consequently the total height of the telescopic post assembly 6. The first spring-loaded button 15 latches into the first tube 10 while preserving the structural integrity of the first tube 10, as the at least one height-adjustable hole 17 traverses into the first tube 10. Similarly, the second spring-loaded button 16 is terminally positioned with the first tube 10, adjacent with the second tube 11, and is laterally mounted into the first tube 10, adjacent with the second tube 11. This arrangement maximizes the height of the first tube 10 and the second tube 11. The second spring-loaded button 16 latches into the second tube 11 while preserving the structural integrity of the second tube 11, as the anchoring hole 18 traverses into the second tube 11. The first spring-loaded button 15 is slidably engaged into the at least one height-adjustable hole 17 in order to establish a desired height of the present invention and define the total height of the telescopic post assembly 6. Likewise, the second spring-loaded button 16 is slidably engaged into the anchoring hole 18 in order to secure the telescopic post assembly 6 with the stake 19.

The present invention further comprises at least one first notch 29 and a second notch 30 to facilitate the engagement of the first spring-loaded button 15 and the second spring-loaded button 16, seen in FIG. 2 and FIG. 3. The at least one first notch 29 is externally integrated into the first tube 10 and is positioned adjacent with the at least one height-adjustable hole 17, allowing the first spring-loaded button 15 to be fully engaged and pushed back into the connecting post 7. Similarly, the second notch 30 is externally integrated into the second tube 11 and is positioned adjacent with the anchoring hole 18, allowing the second spring-loaded button 16 to be fully engaged and pushed back into the first tube 10.

The connection between the tray 1 and the telescopic post assembly 6 is further reinforced as the tray 1 further comprises a friction-inducing layer 5, seen in FIG. 3. The friction-inducing layer 5 is preferably a rubber-like layer that requires some force to connect and disconnect the tray 1 with the connecting post 7. In order to engage the flange 4 with the connecting post 7, the friction-inducing layer 5 is positioned within the flange 4 and laterally traverses across the flange 4. More specifically, the friction-inducing layer 5 is positioned in between the flange 4 and the connecting post 7.

In the preferred embodiment of the present invention, the stake 19 comprises a shaft 22, a plurality of blades 23, and a pointed base 28, seen in FIG. 1, FIG. 2, FIG. 3, FIG. 4, FIG. 5, and FIG. 6. The shaft 22 offsets the plurality of blades 23 and the pointed base 28 from the second tube 11 of the telescopic post assembly 6. Moreover, the proximal end 20 is terminally positioned within the shaft 22. In order for the stake 19 to pierce into the ground while preserving the arrangement of the telescopic post assembly 6 and the tray 1 with the telescopic post assembly 6, the pointed base 28 is positioned adjacent with the shaft 22, opposite the telescopic post assembly 6. Moreover, the distal end 21 is positioned adjacent with the pointed base 28, opposite the shaft 22. The upright orientation of the present invention is stabilized as the plurality of blades 23 is radially distributed around the shaft 22 and is positioned adjacent with the pointed base 28. The pointed base 28 tapers from the shaft 22 to the distal end 21, facilitating the insertion of the pointed base 28 into the ground.

Figure 4:
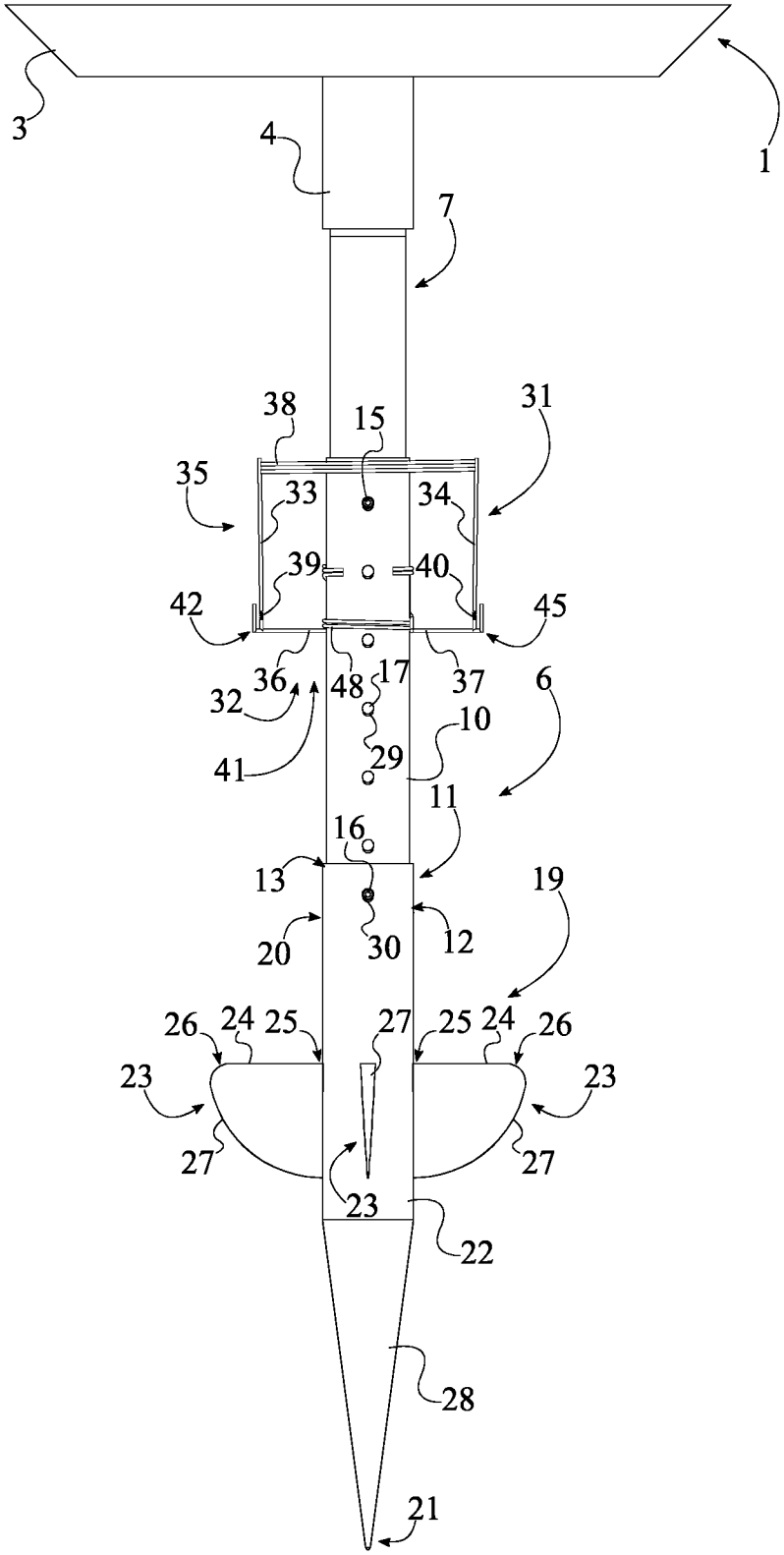
FIG. 4 is a front side view of the present invention.
Figure 5:
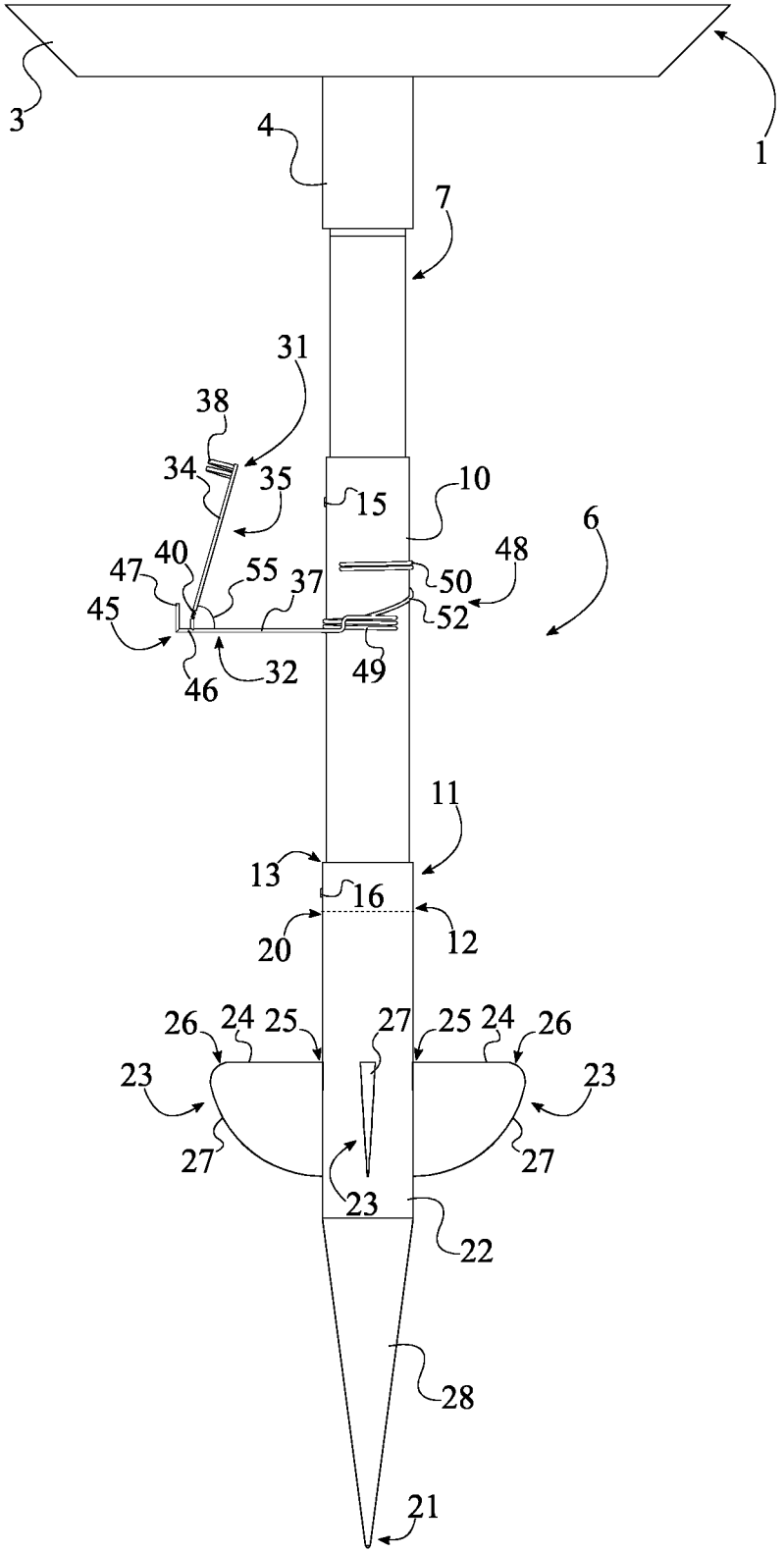
FIG. 5 is a right side view of the present invention.
Figure 6:
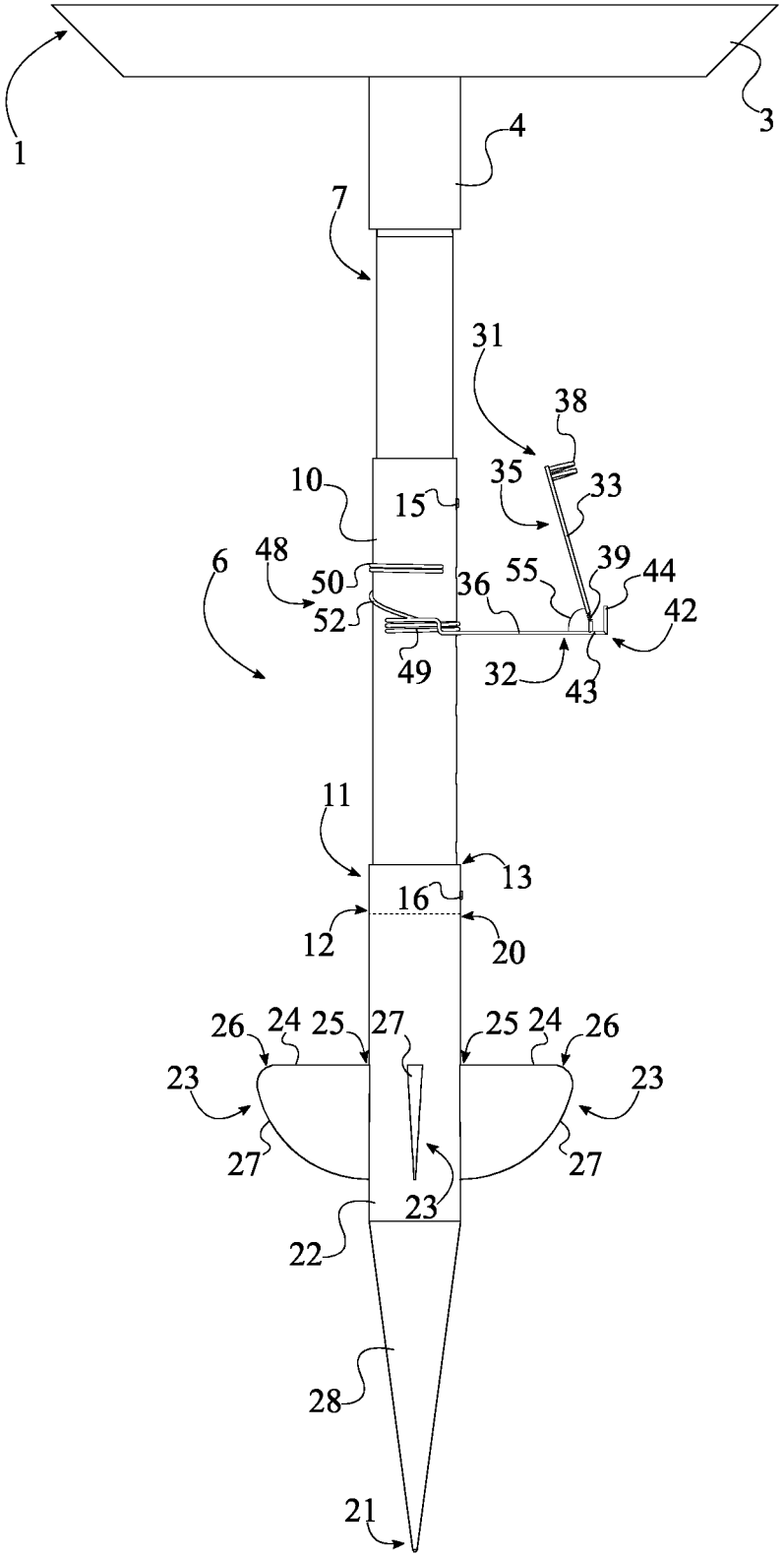
FIG. 6 is a left side view of the present invention.

The mounting of the stake 19 into the ground is further facilitated as each blade of the plurality of blades 23 comprises a planar edge 24 and a tapered edge 27, seen in FIG. 4, FIG. 5, and FIG. 6. The planar edge 24 serves as a footrest so that the proper leverage of force may be applied with a foot of the user. The tapered edge 27 allows each blade to smoothly traverse into the ground. The planar edge 24 is oriented perpendicular with the shaft 22, serving as a stable platform for a foot. More specifically, an inner end 25 of the planar edge 24 is positioned opposite an outer end 26 of the planar edge 24, and the inner end 25 is fixed with the shaft 22. The tapered edge 27 traverses from the outer end 26 to the shaft 22, preserving the desired contour of the stake 19 that easily penetrates into the ground.

In order to further maximize space to store more items with the present invention, the present invention further comprises a beverage holder 31, an electronic device holder 41, and a spring clamp 48, seen in FIG. 1, FIG. 2, FIG. 3, FIG. 4, FIG. 5, and FIG. 6. The beverage holder 31 contains and upholds a beverage, and the electronic device holder 41 contains and upholds an electronic device such as a smart phone. The spring clamp 48 connects and disconnects both the beverage holder 31 and the electronic device holder 41. The compact structure of the present invention is preserved as the beverage holder 31 is positioned adjacent with the telescopic post assembly 6, and the electronic device holder 41 is positioned adjacent with the beverage holder 31, opposite the telescopic post assembly 6. This arrangement also facilitates access to both the beverage and the smart device. The spring clamp 48 is positioned adjacent with the beverage holder 31, opposite the electronic device holder 41, providing a secure and stable connection of both the beverage holder 31 and the electronic device holder 41 with that of the telescopic post assembly 6. More specifically, the electronic device holder 41 and the spring clamp 48 are fixed with the beverage holder 31. The tray 1 remains uninhibited by the beverage holder 31 and the electronic device holder 41 as the spring clamp 48 is laterally mounted around the telescopic post assembly 6. Consequently, the tray 1 serves as a cover or shield to both the beverage holder 31 and the electronic device holder 41.

In the preferred embodiment of the present invention, the beverage holder 31 comprises a base 32 and a frame 35, seen in FIG. 1, FIG. 2, FIG. 3, FIG. 4, FIG. 5, and FIG. 6. The base 32 upholds a beverage, and the frame 35 contains the beverage on top of the base 32. In order to maintain balance for the present invention, the base 32 comprises a first arm 33 and a second arm 34, and the frame 35 comprises a third arm 36 and a fourth arm 37, minimizing the overall weight of the beverage holder 31. The bottom of the beverage is balanced across both the first arm 33 and the second arm 34. The third arm 36 and the fourth arm 37 surround the beverage with the telescopic post assembly 6. The beverage safely upheld by the base 32 as the first arm 33 is terminally fixed with the spring clamp 48, and the second arm 34 is terminally fixed with the spring clamp 48. More specifically, the first arm 33 is angularly offset from the second arm 34, further maintaining the overall balance of the present invention. The frame 35 is fitted around the beverage as the frame 35 is oriented at an acute angle with the base 32. More specifically, the third arm 36 is fixed with the first arm 33, and the fourth arm 37 is fixed with the second arm 34. In the preferred embodiment of the present invention, the acute angle 55 is 70 degrees for a firm, yet flexible grip around a beverage. The beverage and the electronic device are easily accessible as the electronic device holder 41 is positioned adjacent with the frame 35, opposite the base 32.

As beverages are housed within various beverage containers, the beverage holder 31 further comprises an elastic band 38, a first coil spring 39, and a second coil spring 40, seen in FIG. 1, FIG. 2, FIG. 3, FIG. 4, FIG. 5, and FIG. 6. The elastic band 38 secures the top portion of a beverage container. The first coil spring 39 and the second coil spring 40 allows the frame 35 of the beverage holder 31 to be slightly flexible while preserving the structural integrity of the frame 35. In order to engage the top portion of a beverage container, the elastic band 38 is connected in between the third arm 36 and the fourth arm 37 and is positioned offset with the base 32 along the third arm 36 and the fourth arm 37. The beverage holder 31 is able to accommodate beverage containers with varying widths as the first coil spring 39 is integrated in between the third arm 36 and the base 32. Likewise, the second coil spring 40 is integrated in between the fourth arm 37 and the base 32.

In the preferred embodiment of the present invention, the electronic device holder 41 comprises a first prong 42 and a second prong 45, seen in FIG. 5 and FIG. 6. The first prong 42 and the second prong 45, together, upholds an electronic device and anchors the electronic device against the beverage holder 31. More specifically, a fixed end 43 of the first prong 42 is laterally fixed with the third arm 36, and a fixed end 46 of the second prong 45 is laterally fixed with the fourth arm 37. The fixed end 43 of the first prong 42 and the fixed end 46 of the second prong 45 connects the first prong 42 and the second prong 45 with the frame 35 of the beverage holder 31. A free end 44 of the first prong 42 is oriented parallel with the third arm 36, and a free end 47 of the second prong 45 is oriented parallel with the fourth arm 37. This arrangement defines a slot between the free end 44 of the first prong 42 and the free end 47 of the second prong 45 with that of the frame 35, thereby anchoring an electronic device with the frame 35 once positioned into the electronic device holder 41.

In the preferred embodiment of the present invention, the spring clamp 48 comprises a first clamping portion 49, a second clamping portion 50, a connecting bar 52, and a post-receiving channel 51, seen in FIG. 1, FIG. 2, FIG. 3, FIG. 4, FIG. 5, and FIG. 6. The first clamping portion 49 connects the beverage holder 31 with the spring clamp 48. The second clamping portion 50 reinforces the connection of the spring clamp 48 around the connecting post 7. The connecting bar 52 connects the first clamping portion 49 with the second clamping portion 50. Moreover, the connecting bar 52 evenly distributes the stress of the beverage holder, and consequently the electronic device holder, across the first clamping portion 49 to the second clamping portion 50. In order to mount the beverage holder with the connecting post 7, the first clamping portion 49 is positioned adjacent with the beverage holder 31. The connecting bar 52 preserves the grip of the spring clamp 48 around the connecting post 7 as the connecting bar 52 is laterally positioned adjacent with the first clamping portion 49 and the second clamping portion 50. Moreover, the second clamping portion 50 is positioned adjacent with the connecting bar 52, opposite the first clamping portion 49 for a more stable connection between the spring clamp 48 and the connecting post 7. In order for the connecting post 7 to be positioned within the spring clamp 48, the post-receiving channel 51 is positioned through the first clamping portion 49, across the connecting bar 52, and through the second clamping portion 50, and the first clamping portion 49 and the second clamping portion 50 is fixed with the connecting bar 52.

In order for the connecting post 7 to be easily positioned into the spring clamp 48, the spring clamp 48 further comprises a first slot 53 and a second slot 53, seen in FIG. 2 and FIG. 3. The first slot 53 and the second slot 53 together allow the spring clamp 48 to be detached from the connecting post 7 along the sides. The first slot 53 is positioned adjacent with the first clamping portion 49, and the second slot 53 is positioned adjacent with the second clamping portion 50. More specifically, the first slot 53 is positioned opposite with the second slot 53 about the spring clamp 48, for a balanced grip around the connecting post 7. The first slot 53 laterally traverses into the first clamping portion 49. Likewise, the second slot 53 laterally traverses into the second clamping portion 50. More specifically, the structurally integrity of the spring clamp 48 is preserved as the first slot 53 is oriented away from the beverage holder 31.

Although the invention has been explained in relation to its preferred embodiment, it is to be understood that many other possible modifications and variations can be made without departing from the spirit and scope of the invention as hereinafter claimed.

What is claimed is:

1. A portable staked accessory holder comprises:

a tray;

a telescopic post assembly;

a stake;

the tray comprises a base plate, a lateral wall, and a flange;

the stake comprises a proximal end and a distal end;

the lateral wall being positioned adjacent with the base plate;

the lateral wall being perimetrically fixed around the base plate;

the flange being positioned adjacent with the base plate, opposite the lateral wall;

the flange being concentrically fixed with the base plate;

the telescopic post assembly being positioned adjacent with the base plate;

the telescopic post assembly being frictionally engaged into the flange;

the stake being positioned adjacent with the telescopic post, opposite the tray;

the distal end being positioned opposite the proximal end about the stake;

the proximal end being fixed with the telescopic post assembly;

a beverage holder;

an electronic device holder;

a spring clamp;

the beverage holder being positioned adjacent with the telescopic post assembly;

the electronic device holder being positioned adjacent with the beverage holder, opposite the telescopic post assembly;

the spring clamp being positioned adjacent with the beverage holder, opposite the electronic device holder;

the electronic device holder and the spring clamp being fixed with the beverage holder; and, the spring clamp being laterally mounted around the telescopic post assembly.

2. The portable staked accessory holder as claimed in claim 1 comprises:

the beverage holder comprises a base and a frame;

the base comprises a first arm and a second arm;

the frame comprises a third arm and a fourth arm;

the first arm being terminally fixed with the spring clamp;

the second arm being terminally fixed with the spring clamp;

the first arm being angularly offset from the second arm;

the frame being oriented at an acute angle with the base;

the third arm being fixed with the first arm;

the fourth arm being fixed with the second arm; and, the electronic device holder being positioned adjacent with the frame, opposite the base.

3. The portable staked accessory holder as claimed in claim 2 comprises:

the beverage holder further comprises an elastic band, a first coil spring, and a second coil spring;

the elastic band being connected in between the third arm and the fourth arm;

the elastic band being positioned offset with the base along the third arm and the fourth arm;

the first coil spring being integrated in between the third arm and the base; and, the second coil spring being integrated in between the fourth arm and the base.

4. The portable staked accessory holder as claimed in claim 2 comprises:

the electronic device holder comprises a first prong and a second prong;

a fixed end of the first prong being laterally fixed with the third arm;

a fixed end of the second prong being laterally fixed with the fourth arm;

a free end of the first prong being oriented parallel with the third arm; and, a free end of the second prong being oriented parallel with the fourth arm.

5. The portable staked accessory holder as claimed in claim 2, wherein the acute angle is 70 degrees.

6. The portable staked accessory holder as claimed in claim 1 comprises:

the spring clamp comprises a first clamping portion, a second clamping portion, a connecting bar, and a post-receiving channel;

the first clamping portion being positioned adjacent with the beverage holder;

the connecting bar being laterally positioned adjacent with the first clamping portion and the second clamping portion;

the second clamping portion being positioned adjacent with the connecting bar, opposite the first clamping portion;

the post-receiving channel being positioned through the first clamping portion, across the connecting bar, and through the second clamping portion; and, the first clamping portion and the second clamping portion being fixed with the connecting bar.

7. The portable staked accessory holder as claimed in claim 6 comprises:

the spring clamp comprises a first slot and a second slot;

the first slot being positioned adjacent with the first clamping portion;

the second slot being positioned adjacent with the second clamping portion;

the first slot being positioned opposite with the second slot about the spring clamp;

the first slot laterally traversing into the first clamping portion;

the second slot laterally traversing into the second clamping portion; and, the first slot being oriented away from the beverage holder.

* * * * *